United States Patent [19]

Horne

[11] 4,227,047

[45] Oct. 7, 1980

[54] DOME STRUCTURE

[76] Inventor: Edward A. Horne, 231 Western Blvd., Jacksonville, N.C. 28540

[21] Appl. No.: 926,738

[22] Filed: Jul. 21, 1978

[51] Int. Cl.[2] ..... H04R 5/02; E04B 1/32

[52] U.S. Cl. ..... 179/1 E; 52/6; 52/36; 52/81; 179/1 GA

[58] Field of Search ..... 179/1 AT, 1 GA, 1 E; 181/30; 272/25; 52/6, 27, 36, 81, 82

[56] References Cited

U.S. PATENT DOCUMENTS

| | | | |
|---|---|---|---|
| 240,868 | 5/1881 | Waters | 52/81 |
| D. 910,069 | 2/1968 | Cornelius, Jr. | D13/1 |
| 2,278,956 | 4/1942 | Wagner | 52/81 |
| 2,701,025 | 2/1955 | Kuhl | 179/1 GA |
| 2,804,933 | 9/1957 | Imhof . | |
| 3,316,999 | 5/1967 | Jaffe et al. | 181/30 |
| 3,468,083 | 9/1969 | Camoletti et al. | 52/81 |
| 3,627,948 | 12/1971 | Nichols | 179/1 E |
| 3,675,380 | 7/1972 | Moss | 52/82 X |
| 3,763,608 | 10/1973 | Chamlee | 52/82 X |
| 3,828,492 | 8/1974 | Schliemann et al. | 52/36 |
| 3,854,254 | 12/1974 | Janosko | 52/82 X |
| 4,043,086 | 8/1977 | Kaulfuss et al. | 52/36 X |
| 4,057,689 | 11/1977 | Stallings, Jr. | 179/1 E |
| 4,107,461 | 8/1978 | Bose | 179/1 GA |

*Primary Examiner*—Alfred C. Perham

*Attorney, Agent, or Firm*—Berman, Aisenberg & Platt

[57] ABSTRACT

A dome structure which is adapted, in a preferred embodiment, to serve as a listening booth for auditioning stereo components. The structure includes at least one curved dome section having side walls which taper from a broad floor-mounted base to a narrow tip which arches off the floor a distance of, for example, eight feet. In the preferred embodiment, the dome section, or a plurality of interconnected sections, subtends an arc of approximately 60°, the tip portions meeting in a corner of a room. On the inner wall of the dome section are mounted a plurality of speakers, while other stereo components may be mounted on an auxiliary support structure in the corner. A chair may be provided under the dome, along with a control console by means of which a customer may select various combinations of stereo components as a purchasing aid. The dome structure may be utilized as a general store display, an office divider, an outside shelter, a childrens' play area, or the like.

4 Claims, 8 Drawing Figures

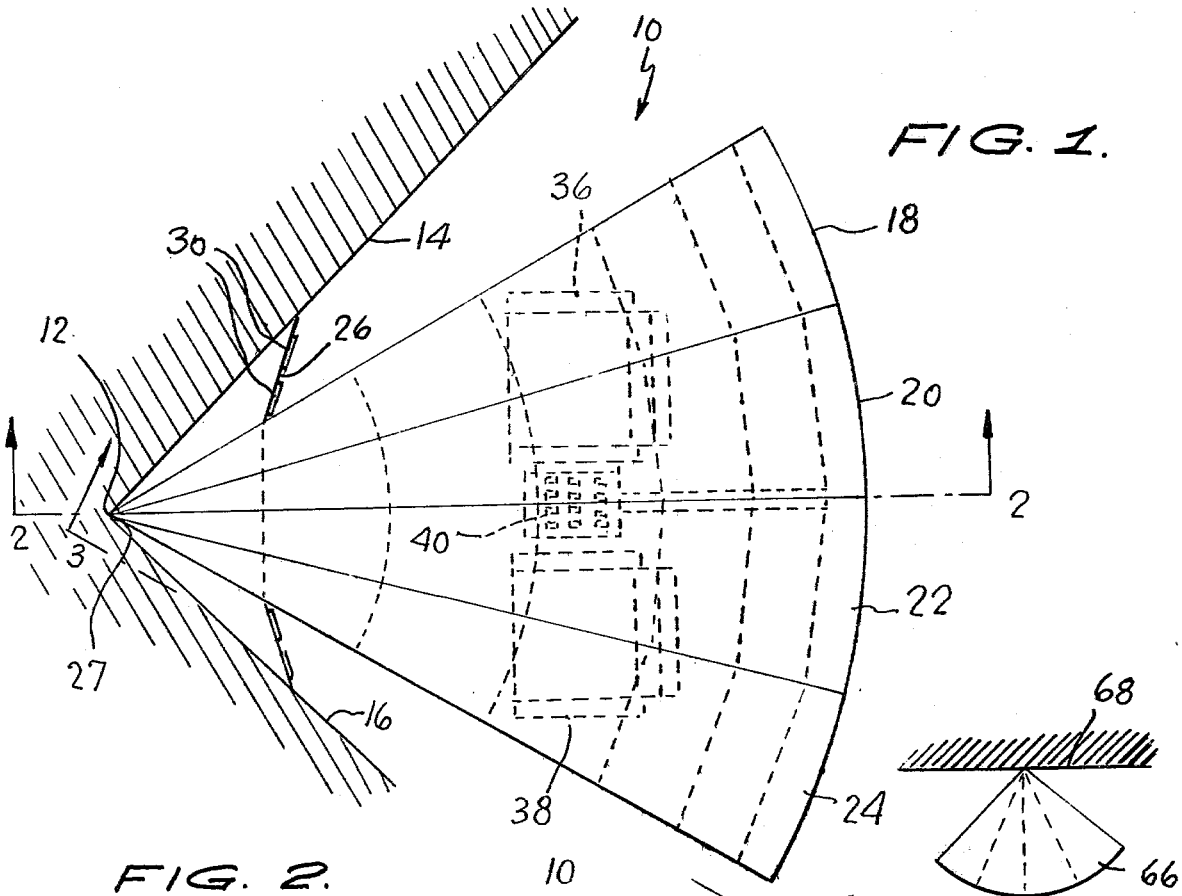
FIG. 1.
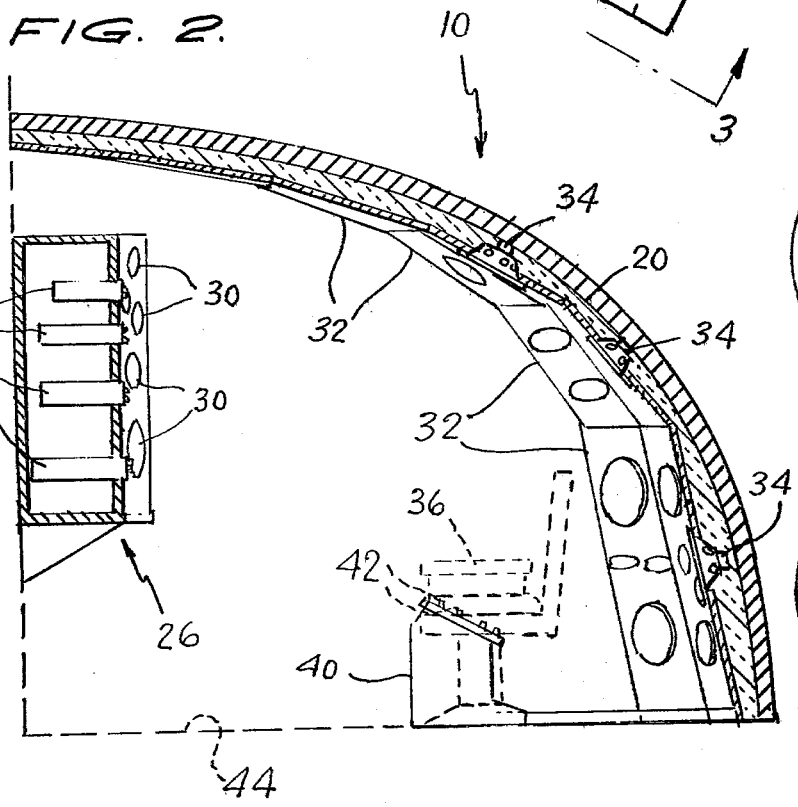
FIG. 2.
FIG. 6.
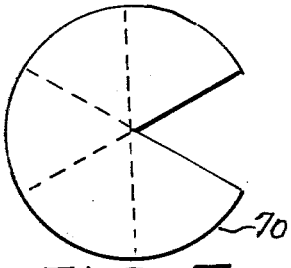
FIG. 7.
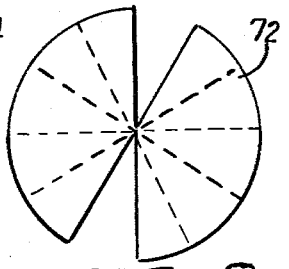
FIG. 8.

DOME STRUCTURE

BACKGROUND OF THE INVENTION

1. Field of the Invention

The present invention is related to dome structures and, more particularly, is directed towards a dome structure having particular utility as an auditioning booth for electronic audio components or the like.

2. Description of the Prior Art

In the retail sale and purchase of electronic stereophonic components, it is customary for the merchant to provide a listening area where the potential customer may test various makes and models of equipment prior to purchase. Previously, such listening areas have consisted largely of unpartitioned portions of the retail store, or completely enclosed small rooms, in which the various stereo radios, tape decks and speakers are installed for testing purposes. Such listening areas, which are generally unattractive, do not lend themselves to duplicating, insofar as possible, the listening conditions one might encounter in one's home or automobile. The acoustics are generally poor, and the consumer therefore has difficulty in discerning the differences between the various types of equipment being tested.

It therefore may be appreciated that it would be extremely desirable if there could be provided a listening area for auditioning electronic stereophonic components which is attractive, easy to use, inexpensive, easy to install, and which recreates, insofar as possible, the eventual listening environment.

Prior Art United States patents in this general area of which I am aware include: De. No. 210,069; U.S. Pat. Nos. 2,278,956; 2,804,933; 3,316,999; 3,468,083; 3,675,380; 3,763,608; and 4,043,086.

OBJECTS AND SUMMARY OF THE INVENTION

It is therefore a primary object of the present invention to provide a structure which may be utilized as a listening area for auditioning electronic stereo components which overcomes all of the disadvantages noted above with respect to prior art structures.

Another object of the present invention is to provide a dome structure which may be utilized as either an auditioning booth for stereo components, a general display area for a retail store, an area for entertaining children, an office divider, an outside shelter, or the like.

An additional object of the present invention is to provide a dome structure which may be easily constructed out or readily available components, is inexpensive to manufacture, and may be readily installed in any desired size.

A still further object of the present invention is to provide a dome structure which is adapted to be utilized in connection with an existing section of a wall or corner in a room as a means for supporting a portion thereof.

A still further object of the present invention is to provide a modular dome structure which is formed of a plurality of substantially identical dome sections which may be pieced together in any desired shape and number for a plurality of different purposes or uses.

The foregoing and other objects are attained in accordance with one aspect of the present invention through the provision of a dome structure which comprises at least one dome section which is curved on its outer surface and which includes a pair of side walls which taper towards one another from a base portion adapted to contact the floor to a tip portion raised off the floor. The side walls meet at the tip portion, the junction thereof defining a substantially vertical axis about which additional dome sections may be positioned.

In accordance with other aspects of the present invention, the dome section further includes a plurality of removable panels which are attached to the inner surface thereof. In a preferred embodiment, the panels include means for mounting stereo components, such as speakers, therein. In a best mode, the dome section traverses an arc less than 90° whereby the tip portion may be adapted to be supported in a corner of a room. An auxiliary support member may be mounted in the corner of the room for mounting additional stereo components, such as radios, tape decks and speakers. Seating means and a control console may also be positioned under the dome section for permitting the listener to select various combinations of stereo speakers and components during an audition.

In accordance with another aspect of the present invention, a plurality of substantially identical dome sections may be provided, the side walls of adjacent sections being adapted to abut one another, while the tip portions of the sections meet at a common point.

BRIEF DESCRIPTION OF THE DRAWINGS

Various objects, features and attendant advantages of the present invention will be more fully appreciated as the same becomes better understood from the following detailed description of the present invention considered in connection with the accompanying drawings, in which:

FIG. 1 is a top view which illustrates a preferred embodiment of a dome structure utilized as a listening booth in accordance with the present invention;

FIG. 2 is a cross sectional view of the preferred embodiment illustrated in FIG. 1 and taken along line 2—2 thereof;

FIG. 6 is a schematic representation of an alternative embodiment of the present invention;

FIG. 7 is a schematic representation of yet another alternative embodiment of the present invention; and FIG. 8 is a schematic representation of yet another alternative embodiment of the present invention.

DETAILED DESCRIPTION OF THE PREFERRED EMBODIMENTS

Figure 3:
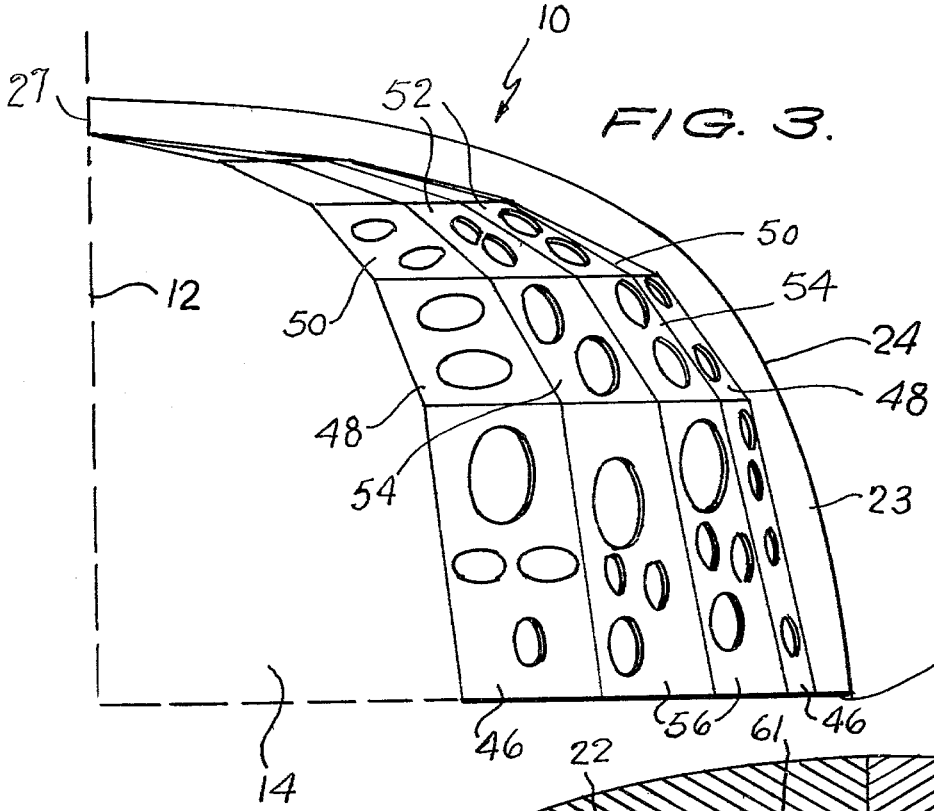
FIG. 3 is an end view of the preferred embodiment illustrated in FIG. 1 taken along line 3—3 thereof.

Referring now to the drawings, wherein like reference numerals represent identical or corresponding parts throughout the several views, a preferred embodiment of the dome structure of the present invention is indicated generally by reference numeral 10. Although the dome structure 10 of the present invention will be hereinafter described and illustrated in its preferred embodiment as comprising an audio listening area for auditioning electronic stereophonic components, and the like, it will be understood that the dome structure may be just as easily utilized for other purposes, such as, for example, a display area in a general retail store, a cubical for entertaining children in a doctors' waiting room, an office divider, an outside shelter, or the like.

The audio component listening dome 10 is seen to be comprised of an arched dome-like section of a sphere which may consist of either a one-piece outer shell, constructed of wood or the like, or a plurality of substantially identical dome sections 18, 20, 22 and 24. Each dome section, such as dome section 24, has a pair of side walls 23 and 25 which taper from a broad base 21 to a narrow tip 27. The base 21 is adapted to be supported on the floor 44 of the room, while the tip 27, in the illustrated embodiment, is adapted to be supported in the corner 12 of the room.

Corner 12 is formed by side walls 14 and 16 which customarily meet at a right angle. Each of the tips 27 of the dome sections 18, 20, 22 and 24 may subtend an angle of approximately 15°, so that the entire dome structure 10 traverses a 60° angle out of the 90° available in the corner of the room. This means that easy access may be provided to the interior of the dome 10 between the walls 14 and 16 and the open sides. Of course, greater or fewer dome sections could be provided than those illustrated in FIGS. 1 through 4, depending on the particular requirements of the user. As illustrated in FIG. 6, for example, the dome structure 66 could be mounted on a straight wall 68. Alternatively, a plurality of larger dome sections may form a display structure 70 to be positioned in the center of a room as illustrated schematically in FIG. 7. An alternative arrangement of another partial sphere 72 is illustrated in FIG. 8. It may be seen that the dome 66 of FIG. 6 is provided by four identical dome sections each of which may traverse an angle of about 20°–25 , while the almost enclosed dome 70 of FIG. 7 is formed of five substantially identical sections each of which traverses an angle of about 60°. Still alternatively, the design of FIG. 8 utilizes 10 individual dome sections each of which traverses an angle of 30°.

Referring back to FIGS. 1 through 4, the dome sections 18, 20, 22 and 24 may be formed of any suitable material, such as fiberglass, plastic, or the like. The inside surface of each of the dome sections has a plurality of removable panels 32 which, in the preferred embodiment, are adapted for mounting a plurality of stereo speakers 34 thereon. The speakers 34 are arranged in a symmetric fashion on the panels 32 and may be of a plurality of different sizes, shapes, quality, and the like.

As illustrated in FIG. 3, for example, two identical speaker placement panels 46 are mounted to the lower portion of the inner walls of the end dome sections 18 and 24. Another set of identical speaker mounting panels 48 are provided above panels 46, and panel set 50 are provided above panel set 48. In the middle two dome sections 20 and 22, there are provided substantially identical speaker panel pairs 52, 54 and 56.

Note that the placement of the various speaker panels on the interior surface of the dome sections 18, 20, 22 and 24 is so as to be symmetrical about a pair of listening chairs 36 and 38 which are preferably provided underneath the dome structure 10 for the convenience of the customer.

The listening booth system of the present invention also preferably includes an auxiliary support structure 26 which is attached to the side walls 14 and 16 by any suitable means and which is provided for mounting various electronic components 28 which may comprise, for example, stereo radios, tape decks, or the like. Speakers 30 may also be mounted in the front console 26 to provide additional listening versatility.

Between the listening chairs 36 and 38 is preferably provided a control console 40 which has a plurality of control switches 42 within easy reach of a customer so that he may select various combinations of stereo speakers 34 and stereo components 28 for listening. The wiring of the control console 40 is conventional and forms no part of the present invention. Suffice it to say that the switches 42 simply connect various of the speakers with various of the radios or tape decks 28 to permit the listener to audition the particular combinations of equipment available.

Figure 5:
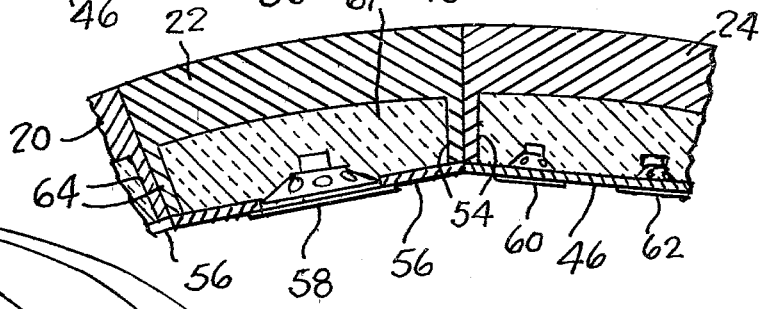
FIG. 5 is a sectional view of the dome structure taken along line 5—5 of FIG. 4.
Figure 4:
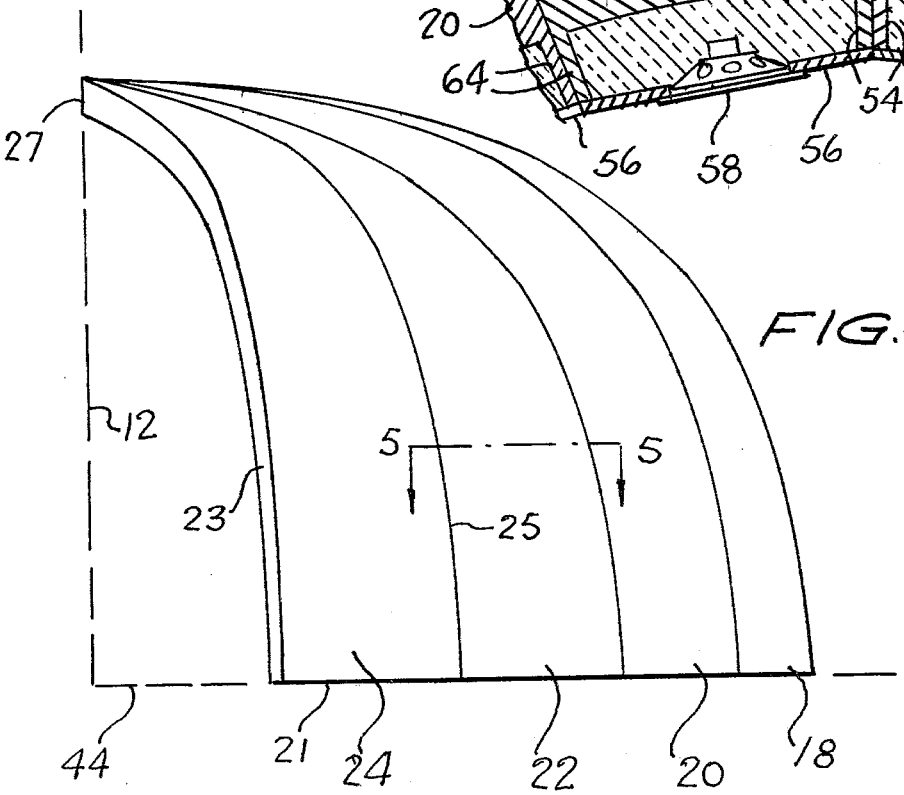
FIG. 4 is a perspective, side view in elevation from the outside of the preferred embodiment of the dome structure illustrated in FIGS. 1 through 3.

FIG. 5 illustrates a cross sectional view of the dome section 22 and the adjacent dome sections 20 and 24. Each of the dome sections is seen to include a pair of inwardly projecting flanges 64 upon which the panels 46 and 56 are mounted. Illustrated in FIG. 5 are speakers 58, 60 and 62 mounted within the apertures formed in the panels 56 and 46. Positioned behind the speakers is a suitable baffle material 61, such as fiberglass. The flanges 64 may be bolted or otherwise secured together in the construction of the dome structure 10.

The preferred embodiment of the dome 10 of the present invention typically forms a structure which is eight feet high at the central portion (tip portion 27), and in which the outer curved surface is positioned approximately ten feet from the vertical axis formed by the tip portions 27. The thickness of each of the dome sections 18 through 24 is on the order of 6 inches.

Obviously, numerous modifications and variations of the present invention are possible in light of the above teachings. It is therefore to be understood that within the scope of the appended claims, the invention may be practiced otherwise than as specifically described herein.

I claim as my invention:

1. An audition booth for stereo components adapted to be portably erected in a room having at least one corner formed by intersecting walls and a floor, comprising:

(a) at least two dome sections having arcuate outer walls and means for mounting a plurality of audio components on their inner walls, said at least two dome sections having base portions supported on said floor and side walls which taper to a tip for support by said corner of the room, one side wall of one of said sections abutting against a side wall of another of said sections and the tip portions of said sections meeting at a common point so as to form a continuous partial dome;

(b) at least one seat positioned within said partial dome and under the inner wall thereof for holding a listener; and (c) control console means positioned adjacent said seat for permitting said listener to select various combinations of said audio components for auditioning purposes.

2. The audition booth set forth in claim 1 wherein said audio components comprise speakers and further including an auxiliary support means mounted adjacent said corner for holding other audio components to be tested in combination with at least one of said speakers and under the control of said control console means.

3. The audition booth set forth in claim 2 wherein said means for mounting comprises a plurality of removable panels attached to the inner surfaces of said dome sections for mounting said speakers.

4. The audition booth set forth in claim 3 wherein said at least two dome sections together traverse an arc of less than 90°.

* * * * *